US005200613A

United States Patent [19]

Kelley

[11] Patent Number: 5,200,613

[45] Date of Patent: Apr. 6, 1993

[54] MASS SPECTROMETRY METHOD USING SUPPLEMENTAL AC VOLTAGE SIGNALS

[75] Inventor: Paul E. Kelley, San Jose, Calif.

[73] Assignee: Teledyne MEC, Mountain View, Calif.

[21] Appl. No.: 753,325

[22] Filed: Aug. 30, 1991

Related U.S. Application Data

[63] Continuation-in-part of Ser. No. 622,191, Feb. 28, 1991.

[51] Int. Cl.[5] ..... H01J 49/42

[52] U.S. Cl. ..... 250/282; 250/291; 250/292

[58] Field of Search ..... 250/282, 291, 292

[56] References Cited

U.S. PATENT DOCUMENTS

| | | | |
|---|---|---|---|
| 4,540,884 | 9/1985 | Stafford et al. | 250/282 |
| 4,686,367 | 8/1987 | Louris et al. | 250/290 |
| 4,736,101 | 4/1988 | Syka et al. | 250/292 |
| 4,749,860 | 6/1988 | Kelley et al. | 250/282 |
| 4,761,545 | 8/1988 | Marshall et al. | 250/291 |
| 4,882,484 | 11/1989 | Franzen et al. | 250/282 |
| 4,975,577 | 12/1990 | Franzen et al. | 250/291 |
| 5,075,547 | 12/1991 | Johnson et al. | 250/292 |
| 5,134,286 | 7/1992 | Kelley | 250/282 |

FOREIGN PATENT DOCUMENTS

| | | |
|---|---|---|
| 0237268 | 9/1987 | European Pat. Off. . |
| 0336990 | 10/1989 | European Pat. Off. . |
| 0362432 | 4/1990 | European Pat. Off. . |
| 0383961 | 6/1990 | European Pat. Off. . |

OTHER PUBLICATIONS

Extension of Dynamic Range in Fourier Transform Ion Cyclotron Resonance Mass Spectrometry via Stored Waveform Inverse Fourier Transform Excitation, Tao-Chin Lin Wang, Tom L. Ricca & Alan Marshall, Anal. Chem., 1986, 5B, 2935-2938.

P. H. Dawson & N. R. Whetten, "Non-Linear Resonances in Quatrupole Mass Spectrometers Due to Imperfect Fields I. The Quadrupole Ion Trap," *J. Mass Spectrometry and Ion Physics*, vol. 2, 1969, pp. 45-59.

*Primary Examiner*—Jack I. Berman

*Attorney, Agent, or Firm*—Limbach & Limbach

[57] ABSTRACT

A mass spectrometry method in which a supplemental AC voltage signal having at least one high power frequency component, and at least one low power frequency component, is applied to an ion trap. Each high power component has an amplitude sufficiently large to eject one or more selected ions from the trap, by resonantly exciting the ions. Each low power component has an amplitude sufficient to induce dissociation (or reaction) of one or more selected ions, but insufficient to resonate the ions for detection. The frequency (or band of frequencies) of each high and low power frequency component is selected to match a resonance frequency of ions having a desired mass-to-charge ratio. Each low power component is applied for the purpose of inducing dissociation or reaction of specific trapped ions, which may be parent, daughter, reagent, or product ions, and each high power component is applied to eject undesired products of each such dissociation or reaction process from the trap. In accordance with the invention, a supplemental voltage signal having appropriately selected high and low power frequency components is applied to a trap during an $(MS)^n$ or CI, or combined $CI/(MS)^n$, mass spectrometry operation.

48 Claims, 7 Drawing Sheets

MASS SPECTROMETRY METHOD USING SUPPLEMENTAL AC VOLTAGE SIGNALS

CROSS-REFERENCE TO RELATED APPLICATION

The present application is a continuation-in-part of pending U.S. patent application Ser. No. 07/662,191, filed Feb. 28, 1991.

FIELD OF THE INVENTION

The invention relates to mass spectrometry methods in which parent ions within an ion trap are dissociated, and resulting daughter, ions are caused to resonate so that they can be detected. More particularly, the invention is a mass spectrometry method in which supplemental AC voltage signals are applied to an ion trap to dissociate parent ions within the trap and to resonate resulting daughter ions for detection.

BACKGROUND OF THE INVENTION

In a class of conventional mass spectrometry techniques known as "MS/MS" methods, ions (known as "parent ions") having mass-to-charge ratio within a selected range are isolated in an ion trap. The trapped parent ions are then allowed, or induced, to dissociate (for example, by colliding with background gas molecules within the trap) to produce ions known as "daughter ions." The daughter ions are then ejected from the trap and detected.

For example U.S. Pat. No. 4 736 101 issued Apr. 5, 1988, to Syka, et al., discloses an MS/MS method in which ions (having a mass-to-charge ratio within a predetermined range) are trapped within a three-dimensional quadrupole trapping field. The trapping field is then scanned to eject unwanted parent ions (ions other than parent ions having a desired mass-to-charge ratio) consecutively from the trap. The trapping field is then changed again to become capable of storing daughter ions of interest. The trapped parent ions are then induced to dissociate to produce daughter ions, and the daughter ions are ejected consecutively (sequentially by m/z) from the trap for detection.

In order to eject unwanted parent ions from the trap prior to parent ion dissociation, U.S. Pat. No. 4,736,101 teaches that the trapping field should be scanned by sweeping the amplitude of the fundamental voltage which defines the trapping field.

U.S. Pat. No. 4,736,101 also teaches that a supplemental AC field can be applied to the trap during the period in which the parent ions undergo dissociation, in order to promote the dissociation process (see column 5, lines 43–62), or to eject a particular ion from the trap so that the ejected ion will not be detected during subsequent ejection and detection of sample ions (see column 4, line 60, through column 5, line 6).

U.S. Pat. No. 4,736,101 also suggests (at column 5, lines 7–12) that a supplemental AC field could be applied to the trap during an initial ionization period, to eject a particular ion (especially an ion that would otherwise be present in large quantities) that would otherwise interfere with the study of other (less common) ions of interest.

It is conventional to perform "higher order MS/MS" operations (sometimes referred to as "$(MS)^n$" operations) in which products of daughter ions (i.e., additional generations of daughter ions) such as "granddaughter ions" are trapped and then excited for detection. For example, in an $(MS)^3$ method (i.e., an MS/MS/MS method), a selected parent ion is dissociated and its daughter ions are trapped and then induced (or permitted) to dissociate (or otherwise react) to produce a species of trapped granddaughter ions. The trapped granddaughter ions are then ejected from the trap for detection.

For another example, in an $(MS)^4$ method (i.e., an MS/MS/MS/MS method), a selected parent ion is dissociated and its daughter ions are trapped and then induced (or allowed) to dissociate (or otherwise react) to produce a species of trapped granddaughter ions, and the granddaughter ions are then induced (or allowed) to dissociate (or otherwise react) to produce a species of trapped great-granddaughter ions. The trapped great-granddaughter ions are then consecutively ejected from the trap for detection.

U.S. Pat. No. 4,686,367, issued Aug. 11, 1987, to Louris, et al., discloses another conventional mass spectrometry technique, known as a chemical ionization or "CI" method, in which stored reagent ions are allowed to react with analyte molecules in a quadrupole ion trap. The trapping field is then scanned to eject product ions which result from the reaction, and the ejected product ions are detected.

European Patent Application 362,432 (published Apr. 11, 1990) discloses (for example, at column 3, line 56 through column 4, line 3) that a broad frequency band signal ("broadband signal") can be applied to the end electrodes of a quadrupole ion trap to simultaneously resonate all unwanted ions out of the trap (through the end electrodes) during a sample ion storage step. EPA 362,432 teaches that the broadband signal can be applied to eliminate unwanted primary ions as a preliminary step to a CI operation, and that the amplitude of the broadband signal should be in the range from about 0.1 volts to 100 volts.

However, conventional $(MS)^n$ and CI methods are capable only of obtaining information of limited scope regarding each sample of interest. It would be desirable to obtain a broader range of information regarding a sample than can be obtained from such conventional methods. To minimize the time required to analyze a sample, and to maximize sample information, it would also be desirable to obtain such information in a manner in which daughter ions of interest, or products of daughter ions of interest, or both, are selectively resonated for detection. However, until the present invention, it was not known how simultaneously to achieve all these objectives in an ion trap.

SUMMARY OF THE INVENTION

In a class of preferred embodiments, the invention is a mass spectrometry method in which a supplemental AC voltage signal having at least one high power frequency component, and at least one low power frequency component, is applied to an ion trap. Each high power component has an amplitude sufficiently large to resonate one or more selected trapped ions for detection, by resonantly exciting the ions. Each low power component has an amplitude sufficient to induce dissociation (or reaction) of one or more selected ions, but insufficient to resonate the ions for detection.

The frequency of each high and low power frequency component of the supplemental AC voltage signal is selected to match a resonance frequency of an ion having a desired mass-to-charge ratio. Each low power component is applied for the purpose of inducing dissociation or reaction of specific ions (i.e., parent, daughter, reagent, or product ions) within the trap. Each high power component is applied to eject products of each dissociation or reaction process from the trap.

In one class of embodiments, a supplemental voltage signal having both high and low power frequency components is applied to a trap during an "$(MS)^n$" operation. A first low power frequency component induces dissociation of parent ions to produce daughter ions (or induces a primary reaction of reagent ions with sample molecules to produce product ions), a second low power frequency component induces dissociation of selected daughter ions (or induces a secondary reaction involving selected product ions resulting from the first reaction), and each high power frequency component resonantly ejects a specific type of ion (for example, a specific daughter ion, granddaughter ion, or product ion from a primary or secondary reaction) from the trap. Finally, selected ions remaining in the trap are excited (in non-consecutive mass order) for detection.

In embodiments of the invention for performing $(MS)^n$ operations, a broadband signal (having a broad frequency spectrum) is applied through a notch filter to an ion trap to resonate all ions except selected parent ions out of the trap (such a notch-filtered broadband signal will be denoted herein as a "filtered noise" signal). Next, a supplemental voltage signal having both high and low power frequency components (of the type described above) is applied to the trap. Finally, selected product ions remaining in the trap are excited (in non-consecutive mass order) for detection.

In another embodiment of the invention, a sequence of supplemental voltage signals (each a pulsed signal having a nonzero, finite frequency bandwidth) is applied to an ion trap, to resonate a desired sequence of selected trapped ions (or sets of ions) for detection.

In yet another embodiment, a filtered noise signal is applied to an ion trap to resonate all ions except selected target ions out of the trap. Next, a supplemental voltage signal having a frequency amplitude spectrum selected for resonating the target ions for detection is applied to the trap, and the resulting target ion signal is integrated. The integrated target ion signal is employed to determine the optimum ionization time (or ionization time and current) needed to maximize the system's sensitivity during target ion detection. Next, the filtered noise signal is applied again to the trap (for the optimum ionization time) to trap an optimal number of target ions. Finally, the trapped target ions are excited for detection (using any of a variety of excitation techniques).

DETAILED DESCRIPTION OF THE PREFERRED EMBODIMENTS

Throughout the specification, including in the claims, the phrase "daughter ion" is used in a broad sense to denote granddaughter ions (second generation daughter ions), great-granddaughter ions (third generation daughter ions), and higher order daughter ions (fourth or subsequent generation daughter ions), as well as ordinary (first generation) daughter ions. Also, throughout the specification, including in the claims, the term "reaction" is used in a broad sense to denote dissociations (of the type that occur in $(MS)^n$ methods), as well as reactions of the type that occur in CI methods.

Figure 1:
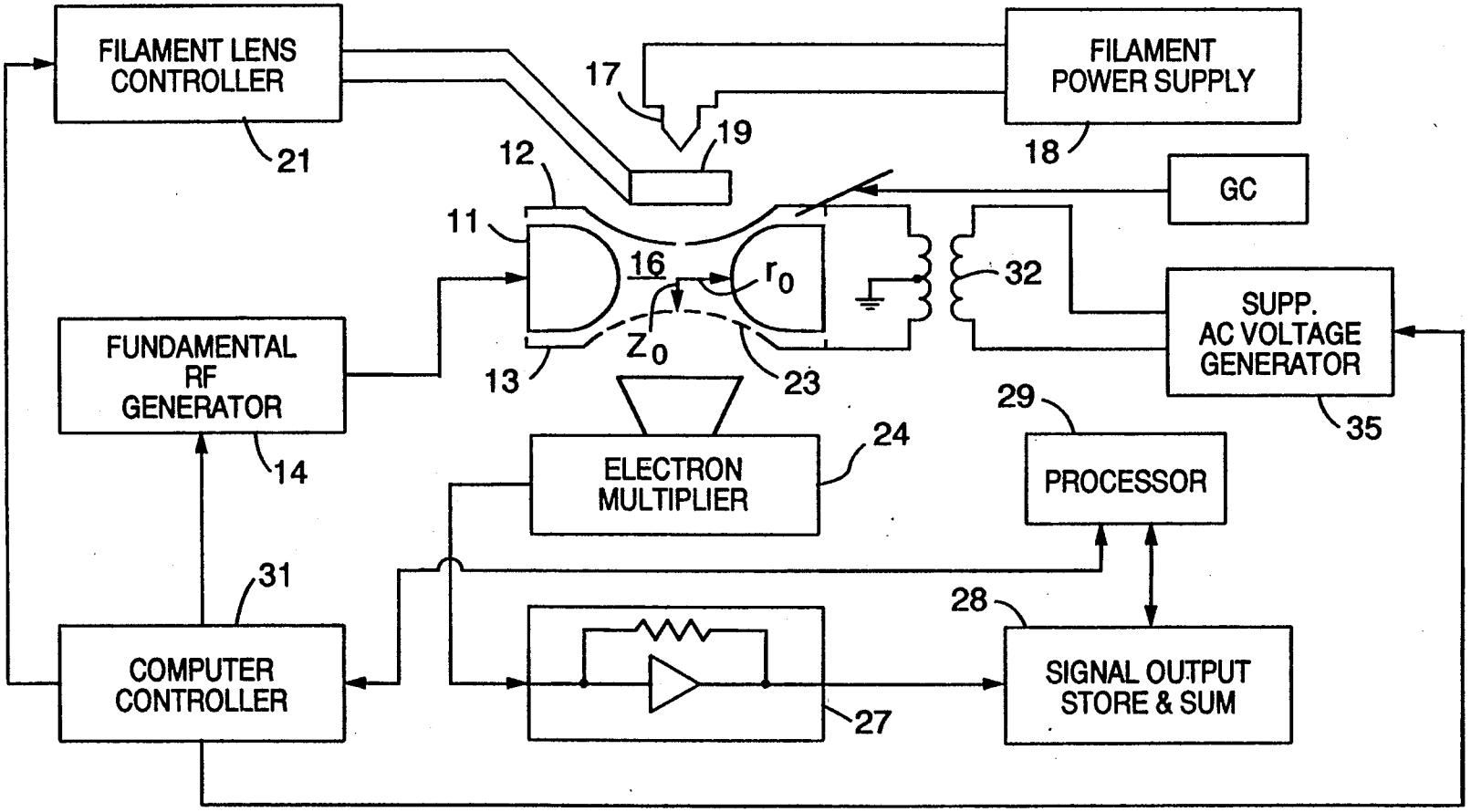
FIG. 1 is a simplified schematic diagram of an apparatus useful for implementing a class of preferred embodiments of the invention.

The quadrupole ion trap apparatus shown in FIG. 1 is useful for implementing a class of preferred embodiments of the invention. The FIG. 1 apparatus includes ring electrode 11 and end electrodes 12 and 13. A three-dimensional quadrupole trapping field is produced in region 16 enclosed by electrodes 11–13, when fundamental voltage generator 14 is switched on to apply a fundamental RF voltage (having a radio frequency component and optionally also a DC component) between electrode 11 and electrodes 12 and 13. Ion storage region 16 has radius $r_o$ and vertical dimension $z_o$. Electrodes 11, 12, and 13 are common mode grounded through coupling transformer 32.

Supplemental AC voltage generator 35 can be switched on to apply a desired supplemental AC voltage signal to electrode 11 or to one or both of end electrodes 12 and 13 (or electrode 11 and one or both of electrodes 12 and 13). The supplemental AC voltage signal is selected (in a manner to be explained below in detail) to resonate desired trapped ions at their axial (or radial) resonance frequencies.

Filament 17, when powered by filament power supply 18, directs an ionizing electron beam into region 16 through an aperture in end electrode 12. The electron beam ionizes sample molecules within region 16, so that the resulting ions can be trapped within region 16 by the quadrupole trapping field. Cylindrical gate electrode and lens 19 is controlled by filament lens control circuit 21 to gate the electron beam off and on as desired.

In one embodiment, end electrode 13 has perforations 23 through which ions can be ejected from region 16 for detection by an externally positioned electron multiplier detector 24. Electrometer 27 receives the current signal asserted at the output of detector 24, and converts it to a voltage signal, which is summed and stored within circuit 28, for processing within processor 29.

In a variation on the FIG. 1 apparatus, perforations 23 are omitted, and an in-trap detector is substituted. Such an in-trap detector can comprise the trap's end electrodes themselves. For example, one or both of the end electrodes could be composed of (or partially composed of) phosphorescent material (which emits photons in response to incidence of ions at one of its surfaces). In another class of embodiments, the in-trap ion detector is distinct from the end electrodes, but is mounted integrally with one or both of them (so as to detect ions that strike the end electrodes without introducing significant distortions in the shape of the end electrode surfaces which face region 16). One example of this type of in-trap ion detector is a Faraday effect detector in which an electrically isolated conductive pin is mounted with its tip flush with an end electrode surface (preferably at a location along the z-axis in the center of end electrode 13). Alternatively, other kinds of in-trap ion detectors can be employed, such as ion detectors which do not require that ions directly strike them to be detected (examples of this latter type of detector include resonant power absorption detection means, and image current detection means).

The output of each in-trap detector is supplied through appropriate detector electronics to processor 29.

A supplemental AC signal of sufficient power can be applied to the ring electrode (rather than to the end electrodes) to resonate unwanted ions in radial directions (i.e., radially toward ring electrode 11) rather than in the z-direction. Application of a high power supplemental signal to the trap in this manner to resonate unwanted ions out of the trap in radial directions before detecting ions using a detector mounted along the z-axis can significantly increase the operating lifetime of the ion detector, by avoiding saturation of the detector during application of the supplemental signal.

Preferably, the trapping field has a DC component selected so that the trapping field has both a high frequency and low frequency cutoff, and is incapable of trapping ions with resonant frequency below the low frequency cutoff or above the high frequency cutoff. Application of a filtered noise signal (of the type to be described below with reference to FIG. 5) to such a trapping field is functionally equivalent to filtration of the trapped ions through a notched bandpass filter having such high and low frequency cutoffs.

Control circuit 31 generates control signals for controlling fundamental voltage generator 14, filament control circuit 21, and supplemental AC voltage generator 35. Circuit 31 sends control signals to circuits 14, 21, and 35 in response to commands it receives from processor 29, and sends data to processor 29 in response to requests from processor 29.

Control circuit 31 preferably includes a digital processor or analog circuit, of the type which can rapidly create and control the frequency-amplitude spectrum of each supplemental voltage signal asserted by supplemental AC voltage generator 35 (or a suitable digital signal processor or analog circuit can be implemented within generator 35). A digital processor suitable for this purpose can be selected from commercially available models. Use of a digital signal processor permits rapid generation of a sequence of supplemental voltage signals having different frequency-amplitude spectra (including those to be described below with reference to FIGS. 3–8).

Figure 2:
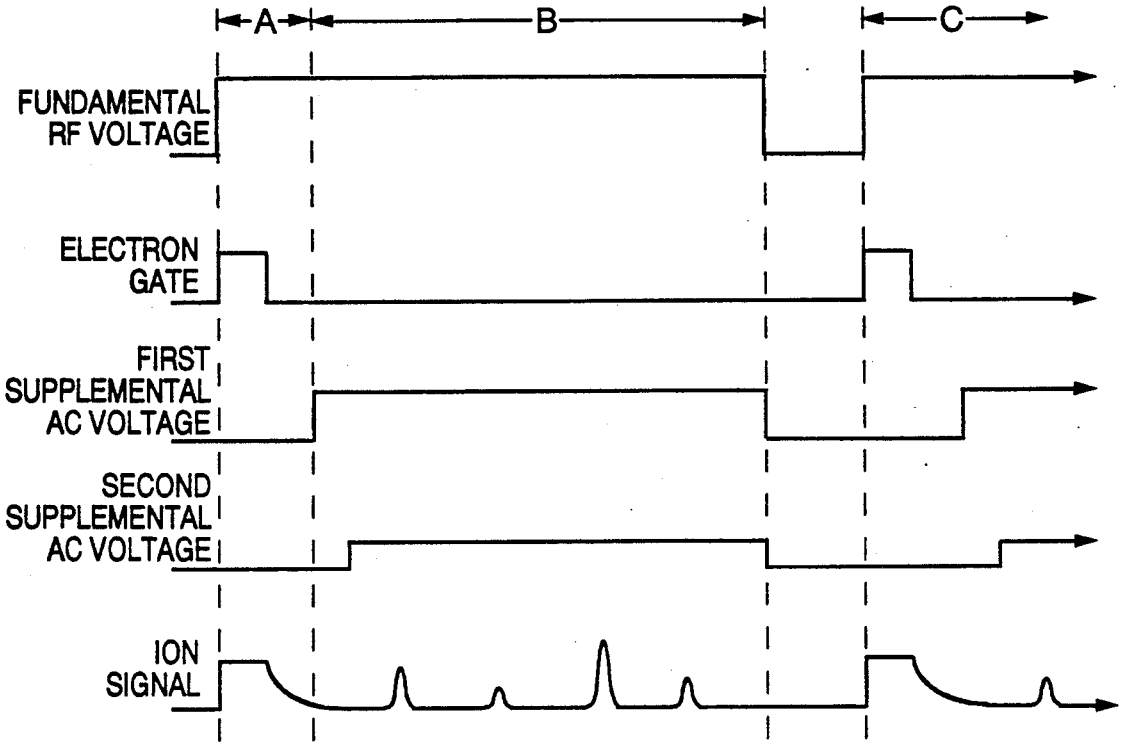
FIG. 2 is a diagram representing signals generated during performance of a first method in which high and low power supplemental voltage signals are applied.

A first method in which high and low power supplemental voltage signals are applied will next be described with reference to FIG. 2. As indicated in FIG. 2, the first step of this method (which occurs during period "A") is to store ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, parent ions can be externally produced and then injected (through lenses, a quadrupole, or other suitable configuration) into storage region 16.

The fundamental voltage signal is chosen so that the trapping field will store (within region 16) ions (for example, parent ions resulting from interactions between sample molecules and the ionizing electron beam) as well as daughter ions (which may be produced during period "B") having mass-to-charge ratio within a desired range. Other ions produced in the trap during period A which have mass-to-charge ratio outside the desired range will escape from region 16.

Before the end of period A, the ionizing electron beam is gated off.

Then, during period B, a first supplemental AC voltage signal is applied to the trap (such as by activating generator 35 of the FIG. 1 apparatus). This voltage signal has a frequency (or band of frequencies) selected to resonantly excite selected daughter ions, and has amplitude (and hence power) sufficiently large to resonate the resonantly excited daughter ions to a degree sufficient to enable them to be detected by an in-trap detector (or by a detector mounted outside the trap).

While generator 35 continues to apply the first supplemental AC voltage to the trap, generator 35 (or a second supplemental AC voltage generator connected to the appropriate electrode or electrodes) is caused to apply a second supplemental AC voltage signal to the trap. The power (output voltage applied) of the second supplemental AC signal is lower than that of the first supplemental voltage signal (typically, the power of the second supplemental signal is on the order of 100 mV while the power of the first supplemental signal is on the order of 1 V). The second supplemental AC voltage signal has a frequency (or band of frequencies) selected to induce dissociation of a particular parent ion (to produce daughter ions therefrom), but has amplitude (and hence power) sufficiently low that it does not resonate significant numbers of the ions excited thereby out of the trap for detection (in embodiments employing an in-trap ion detection means, the second supplemental signal should have sufficient power to resonantly induce dissociation of selected parent ions, but should have sufficiently low power that it does not cause the trajectories of significant numbers of the ions it excites to become large enough for in-trap detection).

Next (also during period B), the frequency of the second supplemental AC signal is changed to induce dissociation of different parent ions. Each daughter ion produced during this frequency scan that happens to have a resonance frequency matching the frequency of the first supplemental signal will be resonated out of the trap for detection (or will be resonated sufficiently for detection by an in-trap detector comprising, or integrally mounted with, a trap electrode). Thus, for example, the "ion signal" portion shown within period B of FIG. 2 has four peaks, each representing detected daughter ions (having a common resonance frequency) resulting from sequential dissociation of four different types of parent ions.

An alternative way to induce dissociation of several different parent ions is to keep the frequency of the second supplemental AC signal fixed, but to change the trapping field parameters (i.e., one or more of the frequency or amplitude of the AC component of the fundamental RF voltage, or the amplitude of the DC component of the fundamental RF voltage). By so changing the trapping field, the frequency of each parent ion (the frequency at which each parent ion moves in the trapping field) is correspondingly changed, and the frequencies of different parent ions can be caused to match the frequency of the second supplemental AC signal. As the trapping field is so changed, the frequency of each daughter ion will also change, and thus, the frequency of the first supplemental AC signal should correspondingly be changed (so that at any instant, the first supplemental AC signal resonates the daughter ion of interest).

During the period which immediately follows period B, all voltage signal sources are switched off. The previous steps can then be repeated (i.e., during period C of FIG. 2).

In a variation on the FIG. 2 method, one (or both) of the first and the second supplemental AC voltage signals has two or more different frequency components (or a band of frequency components) within a selected frequency range. Each such frequency component should have frequency and amplitude characteristics of the type described above with reference to FIG. 2.

Figure 3:
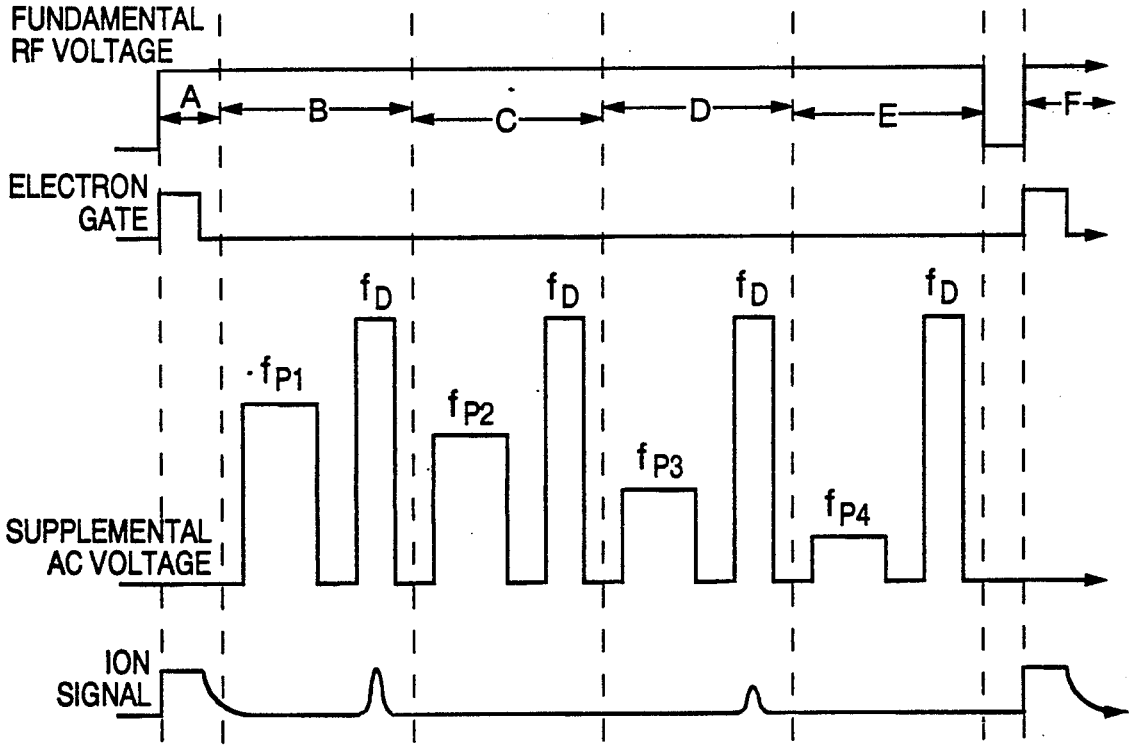
FIG. 3 is a diagram representing signals generated during performance of a second method which high and low power supplemental voltage signals are applied.

Another method in which high and low power supplemental voltage signals are applied to a trap will next be described with reference to FIG. 3. As indicated in FIG. 3, the first step of this method (which occurs during period "A") is to store parent ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, the quadrupole trapping field is established and externally produced ions are injected into storage region 16.

The fundamental voltage signal is chosen so that the trapping field will store (within region 16) daughter ions (which may be produced within the trap after period A) as well as parent ions, all having mass-to-charge ratio within a desired range. Other ions (including ions resulting from interactions with the electron beam during period A), having mass-to-charge ratio outside the desired range, will escape from region 16.

Before the end of period A, the ionizing electron beam is gated off.

Then, during period B, a first supplemental AC voltage signal is applied to the trap (such as by activating generator 35 of the FIG. 1 apparatus). This voltage signal has a frequency ($f_{P1}$), or band of frequencies, selected to induce dissociation of a first parent ion (P1), but has amplitude (and hence power) sufficiently low that it does not resonate significant numbers of the ions it excites to a degree sufficient for in-trap or out-of-trap detection.

Next (also during period B), the first supplemental AC voltage signal is switched off, and a "daughter" supplemental AC voltage signal is applied to the trap to resonate daughters of the first parent ion out of the trap for detection (or to resonate them sufficiently to enable them to be detected by an in-trap detector). Thus, for example, the "ion signal" portion shown within period B of FIG. 3 has a peak representing detected daughter ions resulting from dissociation of the first parent ion during application of the first supplemental signal.

Rather than a single daughter supplemental AC voltage signal (as indicated within period B of FIG. 3), a set of two or more daughter supplemental AC voltage signals can be applied to the trap during period B. Each signal in this set should have a frequency selected to resonate a different daughter of the first parent ion for detection (by an in-trap or out-of-trap detector). An identical set of daughter supplemental AC voltage signals can be applied to the trap during each of periods C, D, and E (to be discussed below).

In general, the frequency of each daughter ion will differ from the frequency of its parent ion. Thus, in one class of embodiments the frequency of each daughter supplemental AC voltage signal will differ from the frequency of the low power supplemental AC voltage signal (i.e., the "first" supplemental AC voltage signal mentioned above, or the "second," "third," or "fourth" supplemental AC voltage signal to be discussed with reference to periods "C," "D," and "E" of FIG. 3) applied to dissociate the parent of the daughter ion to be resonated by the daughter supplemental AC voltage signal.

Alternatively, the trapping field parameters (i.e., one or more of the frequency or amplitude of the AC component of the fundamental RF voltage, or the amplitude of the DC component of the fundamental RF voltage) can be changed following application of the low power supplemental AC voltage signal and before application of the daughter supplemental AC voltage signal. By so changing the trapping field, the frequency of each daughter ion (the frequency at which each daughter ion moves in the trapping field) is correspondingly changed, and indeed the frequency of each daughter ion can be caused to match the frequency of the low power supplemental AC signal. In this latter case, both the daughter supplemental AC voltage signal and the low power supplemental AC voltage signal can have the same frequency (although these two supplemental AC voltage signals are applied to "different" trapping fields).

During period C (shown in FIG. 3), a second supplemental AC voltage signal is applied to the trap (such as by activating generator 35 of the FIG. 1 apparatus). This voltage signal has a different frequency ($f_{P2}$) selected to induce dissociation of a second parent ion (P2), but has amplitude sufficiently low that it does not resonate significant numbers of the ions excited thereby to a degree sufficient for in-trap or out-of-trap detection.

Next (also during period C), the second supplemental voltage signal is switched off, and the daughter supplemental AC voltage signal (or set of daughter supplemental AC voltage signals) is again applied to the trap to resonate daughters of the second parent ion for detection by an in-trap or out-of-trap detector. FIG. 3 reflects the possibility that no such daughter ions of interest will have been produced in response to application of the second supplemental signal. Thus, the ion signal portion shown within period C of FIG. 3 has no peak representing detected daughter ions produced by dissociation of second parent ions during application of the second supplemental signal.

During period D, a third supplemental AC voltage signal is applied to the trap (such as by activating generator 35 of the FIG. 1 apparatus). This voltage signal has a frequency ($f_{P3}$) selected to induce dissociation of a third parent ion (P3), but has amplitude (and hence power) sufficiently low that it does not resonate significant numbers of the ions excited thereby to a degree sufficient for in-trap or out-of-trap detection.

Next (also during period D), the third supplemental voltage signal is switched off, and the daughter supplemental AC voltage signal (or set of daughter supplemental AC voltage signals) is again applied to the trap to resonate daughters of the third parent ion for detection by an in-trap or out-of-trap detector. The "ion signal" portion shown within period D of FIG. 3 has a peak representing detected daughter ions resulting from dissociation of the third parent ions during application of the third supplemental signal.

Next, during period E, a fourth supplemental AC voltage signal is applied to the trap (such as by activating generator 35 of the FIG. 1 apparatus). This voltage signal has a different frequency ($f_{P4}$) selected to induce dissociation of a fourth parent ion (P4), but has amplitude sufficiently low that it does not resonate significant numbers of the ions it excites to a degree sufficient for them to be detected.

Next (also during period E), the fourth supplemental voltage signal is switched off, and the daughter supplemental AC voltage signal (or set of daughter supplemental AC voltage signals) is again applied to the trap to resonate daughters of the fourth parent ions out of the trap for detection (or to resonate them sufficiently for detection by an in-trap detector). FIG. 3 reflects the possibility that no such daughter ions will have been produced in response to application of the fourth supplemental signal. Thus, the ion signal portion shown within period E of FIG. 3 has no peak representing detected daughter ions.

During the period which immediately follows period E, all voltage signal sources are switched off. The previous steps can then be repeated (i.e., during period F of FIG. 3).

In variations on the FIG. 3 method, all or some of the supplemental AC voltage signals have two or more different frequency components within a selected frequency range. Each such frequency component should have frequency and amplitude characteristics of the type described above with reference to FIG. 3.

Figure 4:
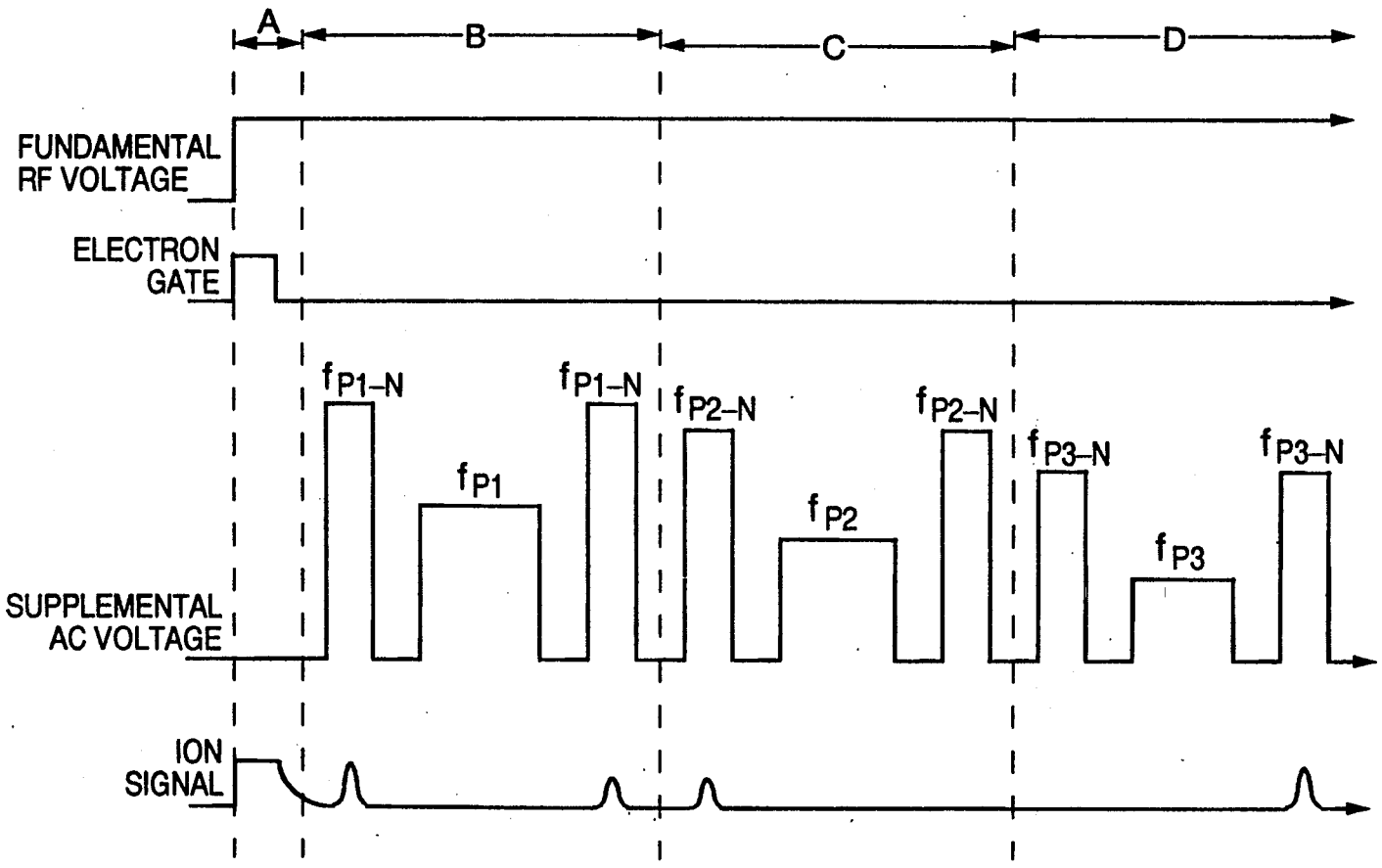
FIG. 4 is a diagram representing signals generated during performance of a third method which high and low power supplemental voltage signals are applied.

A third method in which high and low power supplemental voltage signals are applied to a trap will next be described with reference to FIG. 4. As indicated in FIG. 4, the first step of this method (which occurs during period "A") is to store ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, the quadrupole trapping field is established and externally produced ions are injected into storage region 16.

The fundamental voltage signal is chosen so that the trapping field will store (within region 16) daughter ions (which may be produced within the trap after period A) as well as parent ions, all having mass-to-charge ratio within a desired range. Other ions (including ions resulting from interactions with the electron beam during period A), having mass-to-charge ratio outside the desired range, will escape from region 16.

Before the end of period A, the ionizing electron beam is gated off.

Then, during period B, a first supplemental AC voltage signal is applied to the trap (such as by activating generator 35 of the FIG. 1 apparatus). This voltage signal has a frequency ($f_{P1-N}$) selected to resonantly excite a first ion (having molecular weight P1−N), and has enough power (i.e., sufficient amplitude) to resonate the first ion to a degree enabling it to be ejected from the trap. It could also be detected by an external detector or an in-trap detector.

The FIG. 4 method is particularly useful for analyzing "neutral loss" daughter ions. A neutral loss daughter ion results from dissociation of a parent ion into two components: a daughter molecule (for example, a water molecule) having zero (neutral) charge and a molecular weight N (N will sometimes be denoted herein as a "neutral loss mass"); and a neutral loss daughter ion having a molecular weight P−N, where P is the molecular weight of the parent ion. Thus, during period B of the FIG. 4 method, the first supplemental signal resonates ions having the same mass-to-charge ratio as do neutral loss daughter ions later produced during application of the second supplemental voltage signal (having frequency $f_{P1}$)

Next (also during period B), the first supplemental voltage signal is switched off, and a second supplemental AC voltage signal is applied to the trap. The second supplemental AC voltage signal has frequency selected to induce dissociation of a first parent ion having molecular mass P1. The power of the second supplemental AC signal is lower than that of the first supplemental voltage signal (typically, it is on the order of 100 mV, while the power of the first supplemental voltage signal is on the order of 1 V). The power of the second supplemental AC voltage signal is sufficiently low that this signal does not resonate significant numbers of the ions it excites to a degree sufficient for them to be detected.

Next (also during period B), a third supplemental AC signal is applied to the trap. The third supplemental AC signal has frequency ($f_{P1-N}$), and amplitude sufficient to resonate neutral loss daughter ions having molecular weight P1−N (produced earlier during period B during application of the second supplemental voltage signal) to a degree sufficient for in-trap or out-of-trap detection.

The ion signal portion present during period B of FIG. 4 has two peaks, which occur during application of the first and third supplemental voltage signals. The second peak can unambiguously be interpreted to represent neutral loss daughter ions produced during application of the second supplemental signal, even though the first peak cannot confidently be interpreted to represent neutral loss daughter ions resulting from dissociation of the first parent ion.

Next, during period C, fourth, fifth, and sixth supplemental AC voltage signals are sequentially applied to the trap, to enable detection of neutral loss daughter ions (having molecular weight P2−N) resulting from dissociation of a second parent ion (having molecular weight P2). The fourth and sixth supplemental voltage signals have frequency ($f_{P2-N}$) selected to resonantly excite a second ion (having molecular weight P2−N), and has enough power to resonate the second ion to a degree enabling it to be ejected from the trap. It could also be detected by an external detector or an in-trap detector.

After application of the fourth supplemental voltage signal, this signal is switched off, and the fifth supplemental AC voltage signal is applied to the trap. The fifth supplemental AC voltage signal has frequency selected to induce dissociation of a second parent ion having molecular mass P2. The power of the fifth supplemental AC signal is lower than that of the fourth and sixth supplemental voltage signals (typically, it is on the order of 100 mV), and is sufficiently low that the fifth supplemental signal does not resonate significant numbers of the ions it excites to a degree sufficient for them to be detected.

Next (also during period C), the sixth supplemental AC signal is applied to the trap. The sixth supplemental AC signal has frequency ($f_{P2-N}$), and amplitude sufficient to resonate neutral loss daughter ions having molecular weight P2−N (produced earlier during period C during application of the fourth supplemental voltage signal) to a degree enabling them to be detected.

FIG. 4 reflects the possibility that no such neutral daughter ions will have been produced in response to application of the fifth supplemental signal. Thus, the ion signal portion occurring during application of the sixth supplemental signal (within period C of FIG. 4) has no peak representing detected neutral loss daughter ions produced by dissociation of the second parent ion during application of the fifth supplemental signal, although the ion signal does have a peak representing sample ions detected during application of the fourth supplemental signal.

Finally, during period D, seventh, eighth, and ninth supplemental AC voltage signals are sequentially applied to the trap, to enable detection of neutral loss daughter ions (having molecular weight P3−N) resulting from dissociation of a third parent ion (having molecular weight P3). The seventh and ninth supplemental voltage signals have frequency ($f_{P3-N}$) selected to resonantly excite a third ion (having molecular weight P3−N), and each has enough power to resonate the third ion to a degree enabling it to be detected (by an external detector or an in-trap detector).

After application of the seventh supplemental voltage signal, this signal is switched off, and the eighth supplemental AC voltage signal is applied to the trap. The eighth supplemental AC voltage signal has frequency selected to induce dissociation of a third parent ion having molecular mass P3. The power of the eighth supplemental AC signal is lower than that of the seventh and ninth supplemental voltage signals (typically, it is on the order of 100 mV), and is sufficiently low that the eighth supplemental signal does not resonate significant numbers of the ions it excites to a degree sufficient for them to be detected.

Next (also during period D), the ninth supplemental AC signal is applied to the trap. The ninth supplemental AC signal has frequency ($f_{P3-N}$), and amplitude sufficient to resonate neutral loss daughter ions having molecular weight P3−N (produced during application of the seventh supplemental voltage signal) to a degree enabling them to be detected.

The ion signal portion occurring during application of the ninth supplemental signal (within period D of FIG. 4) has a peak representing detected neutral loss daughter ions produced by dissociation of the third parent ion during application of the eighth supplemental signal, although the ion signal has no peak representing ions detected during application of the seventh supplemental signal.

In one variation on the FIG. 4 method, only the operations described with reference to periods A and B are performed, to detect neutral loss daughter ions of only one parent ion. In other variations on the FIG. 4 method, additional sequences of operations are performed (each including steps corresponding to those described with reference to period B, C, or D), to detect neutral loss daughter ions of more than just three parent ions (as in the method of FIG. 4).

In general, the frequency of each neutral loss daughter ion will differ from the frequency of its parent ion. Thus, in one implementation the frequency of each high power supplemental AC voltage signal applied during one of periods "B," "C," or "D" of FIG. 4 will differ from the frequency of the low power supplemental AC voltage signal applied during the same period of FIG. 4. However, in another implementation the method to change the trapping field parameters (i.e., one or more of the frequency or amplitude of the AC component of the fundamental RF voltage, or the amplitude of the DC component of the fundamental RF voltage) following application of each low power supplemental AC voltage signal and before application of the next high power supplemental AC voltage signal. By so changing the trapping field, the frequency of each neutral loss daughter ion (the frequency at which each neutral loss daughter ion moves in the trapping field) is correspondingly changed, and indeed the frequency of each neutral loss daughter ion can be caused to match the frequency of the low power supplemental AC signal. In this latter case, both the high power supplemental AC voltage signal and the low power supplemental AC voltage signal can have the same frequency (although these two supplemental AC voltage signals are applied to "different" trapping fields).

In other variations on the above-described methods, granddaughter ions (in addition to daughter ions) are produced in ion region 16 and then detected (rather than daughter ions). For example, during step B in the FIG. 2 method, the second (low power) supplemental AC voltage signal can consist of an earlier portion followed by a later portion: the earlier portion having frequency selected to induce production of a daughter ion (by dissociating the parent ion); and the later portion having frequency selected to induce production of a granddaughter ion (by dissociating the daughter ion). In this example, the frequency of the first (high power) supplemental AC voltage signal applied in period B is selected to match a resonance frequency of the granddaughter ion (rather than the daughter ion).

For another example, during step B in the FIG. 3 method, the first (low power) supplemental AC voltage signal consists of an earlier portion followed by a later portion: the earlier portion having frequency selected to induce production of a daughter ion (by dissociating the first parent ion); and the later portion having frequency selected to induce production of a granddaughter ion (by dissociating the daughter ion). In this example, the frequency of the second (high power) supplemental AC voltage signal applied in period B is selected to match a resonance frequency of the granddaughter ion (rather than the daughter ion).

In the claims, the phrase "daughter ion" is intended to denote granddaughter ions (second generation daughter ions) and subsequent (third or later) generation daughter ions, as well as "first generation" daughter ions.

In a variation on the method described with reference to FIG. 3, at least one of the "daughter" supplemental AC voltage signals (or sets of "daughter" supplemental AC voltage signals) is applied twice: once immediately prior to one of the first, second, third, or fourth (low power) supplemental AC voltage signals, and again immediately after the same one of the first, second, third, or fourth (low power) supplemental AC voltage signals. The purpose of each such "preliminary" application of the daughter signal (or set of signals) is to resonate ions having the same mass-to-charge ratio as do daughter ions to be produced later during application of the immediately following low power supplemental voltage signal (as in the method described with reference to FIG. 4).

Figure 5:
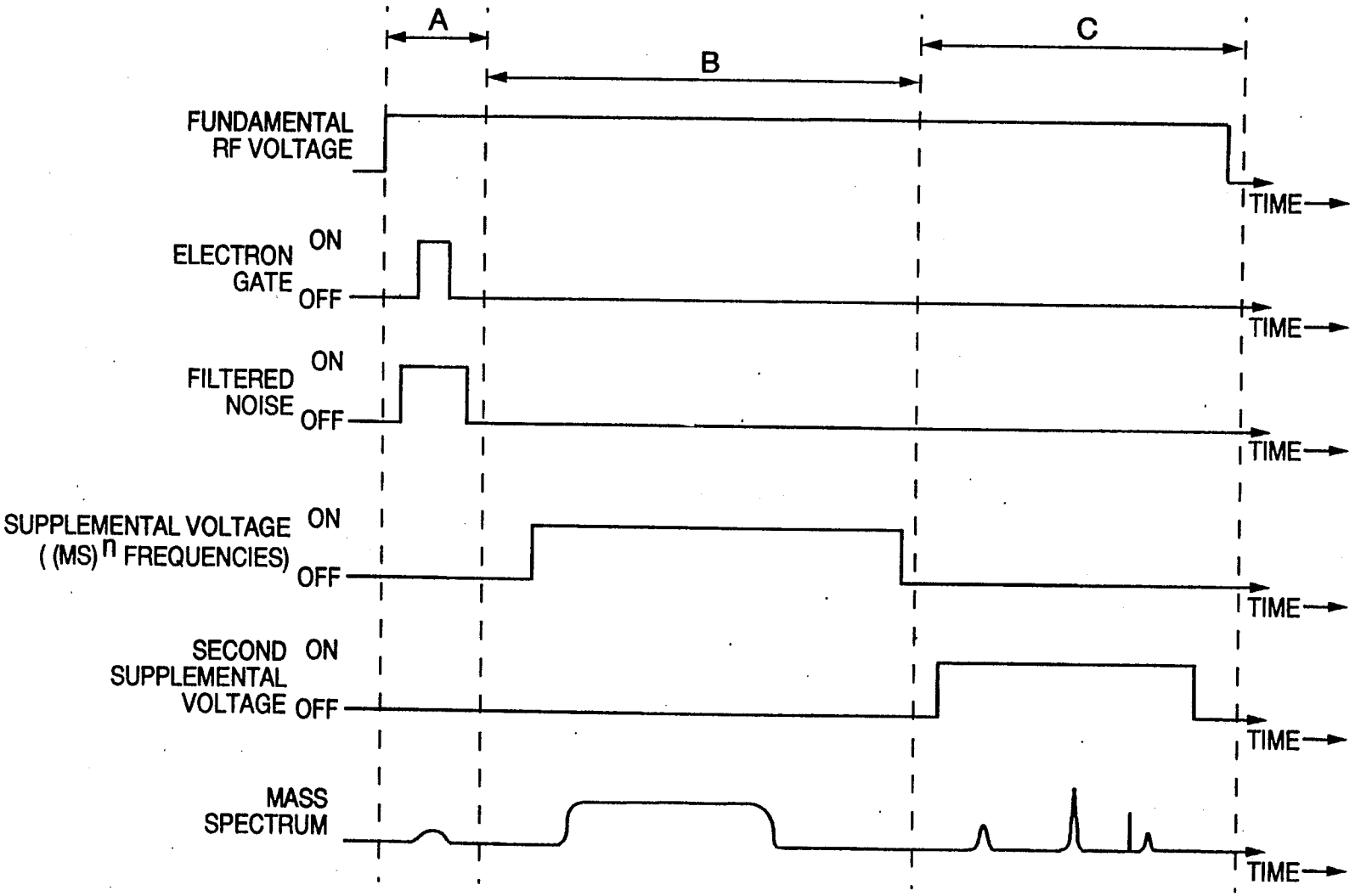
FIG. 5 is a diagram representing signals generated during performance of a first preferred embodiment of the invention.

A preferred embodiment of the inventive method will next be described with reference to FIG. 5. The first step of this method, which occurs during period "A" in FIG. 5, is to store desired parent ions in a trap. This can be accomplished by applying a fundamental voltage signal to the trap (by activating generator 14 of the FIG. 1 apparatus) to establish a quadrupole trapping field, and introducing an ionizing electron beam into ion storage region 16. Alternatively, the quadrupole trapping field is established and externally produced parent ions are injected into storage region 16.

The fundamental voltage signal is chosen so that the trapping field will store (within region 16) selected daughter ions (from all generations of daughter ions to be produced within the trap following step A) and parent ions, having mass-to-charge ratio within a desired range.

Also during step A, a "filtered noise" signal (such as the notch-filtered broadband noise signal in FIG. 6) is applied to the trap. The combined effect of the fundamental voltage signal and the filtered noise signal applied during step A is to cause substantially all undesired ions (including ions resulting from interactions with the electron beam during period A), having undesired mass-to-charge ratios, to escape from region 16.

Before the end of period A, the ionizing electron beam and the filtered noise signal are gated off.

Figure 6:
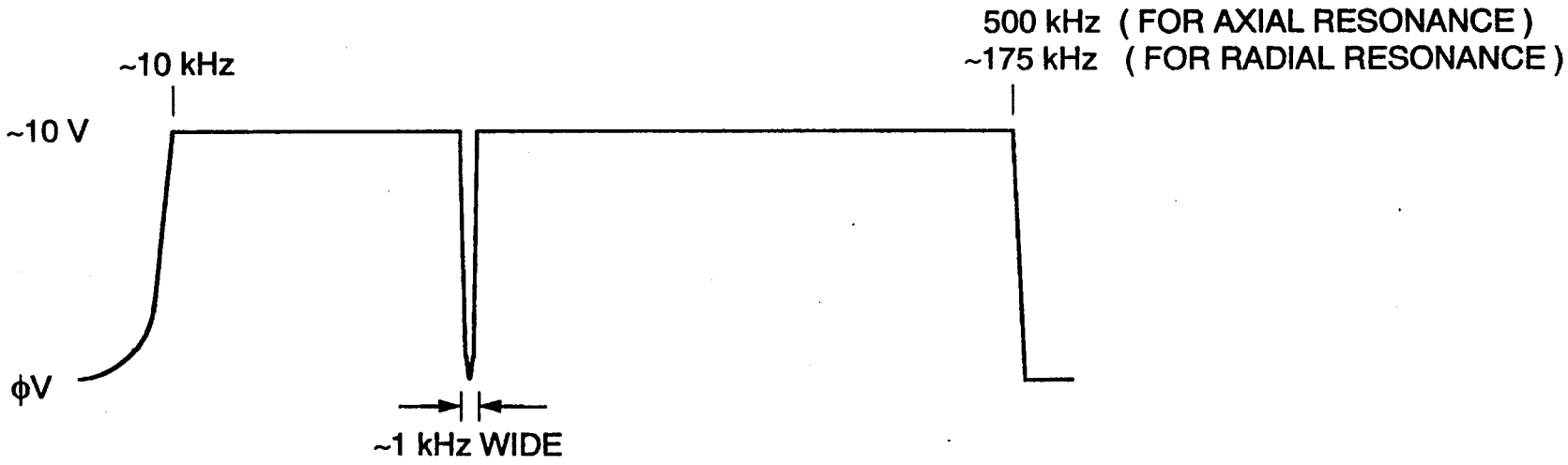
FIG. 6 is a graph representing a preferred embodiment of the notch-filtered broadband signal applied during performance of the invention.

FIG. 6 represents the frequency-amplitude spectrum of a preferred embodiment of the filtered noise signal. The signal of FIG. 6 is intended for use in the case that the RF component of the fundamental voltage signal applied to ring electrode 11 during step A has a frequency of 1.0 MHz, when the fundamental voltage signal has a non-optimal DC component (for example, no DC component at all). The phrase "optimal DC component" will be explained below. As indicated in FIG. 6, the bandwidth of the filtered noise signal of FIG. 6 extends from about 10 kHz to about 500 kHz for axial resonance and from about 10 kHz to about 175 kHz for radial resonance (components of increasing frequency correspond to ions of decreasing mass-to-charge ratio). There is a notch (having width approximately equal to 1 kHz) in the filtered noise signal at a frequency (between 10 kHz and 500 kHz) corresponding to the axial resonance frequency of a particular parent ion to be stored in the trap.

Alternatively, the filtered noise signal can have a notch corresponding to the radial resonance frequency of an ion of interest (i.e., a parent ion) to be stored in the trap (this is useful in a class of embodiments in which the filtered noise signal is applied to the ring electrode of a quadrupole ion trap rather than to the end electrodes of such a trap), or it can have two or more notches, each corresponding to the resonance frequency (axial or radial) of a different ion to be stored in the trap.

Ions produced in (or injected into) trap region 16 during period A, which have a resonant frequency within the frequency range of a notch of the filtered noise signal, will remain in the trap at the end of period A (because they will not be resonated out of the trap by the filtered noise signal), provided that their mass-to-charge ratios are within the range which can be stably trapped by the trapping field produced by the fundamental voltage signal.

To perform $(MS)^n$ mass analysis in accordance with the invention, the filtered noise signal has a notch located at the resonant frequency (or frequencies) of each parent ion to be dissociated.

In the case that the fundamental voltage signal has an optimal DC component (i.e., a DC component chosen to establish both a desired low frequency cutoff and a desired high frequency cutoff for the trapping field), a filtered noise signal with a narrower frequency bandwidth than that shown in FIG. 6 can be employed during performance of step A. Such a narrower bandwidth filtered noise signal is adequate (assuming an optimal DC component is applied) since ions having mass-to-charge ratio above the maximum mass-to-charge ratio which corresponds to the low frequency cutoff will not have stable trajectories within the trap region, and thus will escape the trap even without application of any filtered noise signal. A filtered noise signal having a minimum frequency component substantially above 10 kHz (for example, 100 kHz) will typically be adequate to resonate unwanted parent ions from the trap, if the fundamental voltage signal has an optimal DC component.

After period A, during period B, a supplemental AC voltage signal, having at least one high power frequency component and at least one low power frequency component, is applied to the trap (such as by activating generator 35 of the FIG. 1 apparatus or a second supplemental AC voltage generator connected to the appropriate electrode or electrodes). The amplitude (output voltage applied) of each low power component is sufficient to induce dissociation (or reaction) of a selected ion, but insufficient to eject such ion from the trap (or excite the ion sufficiently for detection). Typically, the amplitude of each low power component is in the range from about 100 mV to about 200 mV. Each high power component has an amplitude (typically, on the order of from 1 volt to 10 volts) that is sufficiently large to eject a selected ion from the trap (i.e., by resonantly exciting the ion).

The frequency of each high and low power frequency component is selected to match a resonance frequency of ions having a specific mass-to-charge ratio. Each low power component is applied for the purpose of inducing dissociation or reaction of specific trapped ions, which may be parent, daughter, reagent, or product ions, and each high power component is applied to resonantly eject undesired products of each dissociation or reaction process from the trap.

In final step "C" of the FIG. 5 method, selected trapped ions are excited for detection. During step C, in a class of preferred embodiments for performing $(MS)^n$ operations, selected daughter ions remaining in the trap after step B are excited in non-consecutive mass order for detection. The excitation of selected ions for detection can accomplished by applying a second supplemental voltage signal to the trap (as shown in FIG. 5).

The second supplemental voltage signal preferably consists of sequentially applied AC pulses, with each pulse having a frequency (or band of frequencies) matching the resonant frequency of ions of interest. In response to each such pulse, ions in the trap having a resonant frequency matching that of the pulse will be rapidly resonated to a degree sufficient for detection (by an in-trap or out-of-trap detector). Co-pending U.S. patent application Ser. No. 07/698,313, filed May 10, 1991 (and assigned to the assignee of the present application), discloses several examples of supplemental voltage signals, suitable for use in step C to excite ions, in non-consecutive mass order, for detection.

Figure 7:
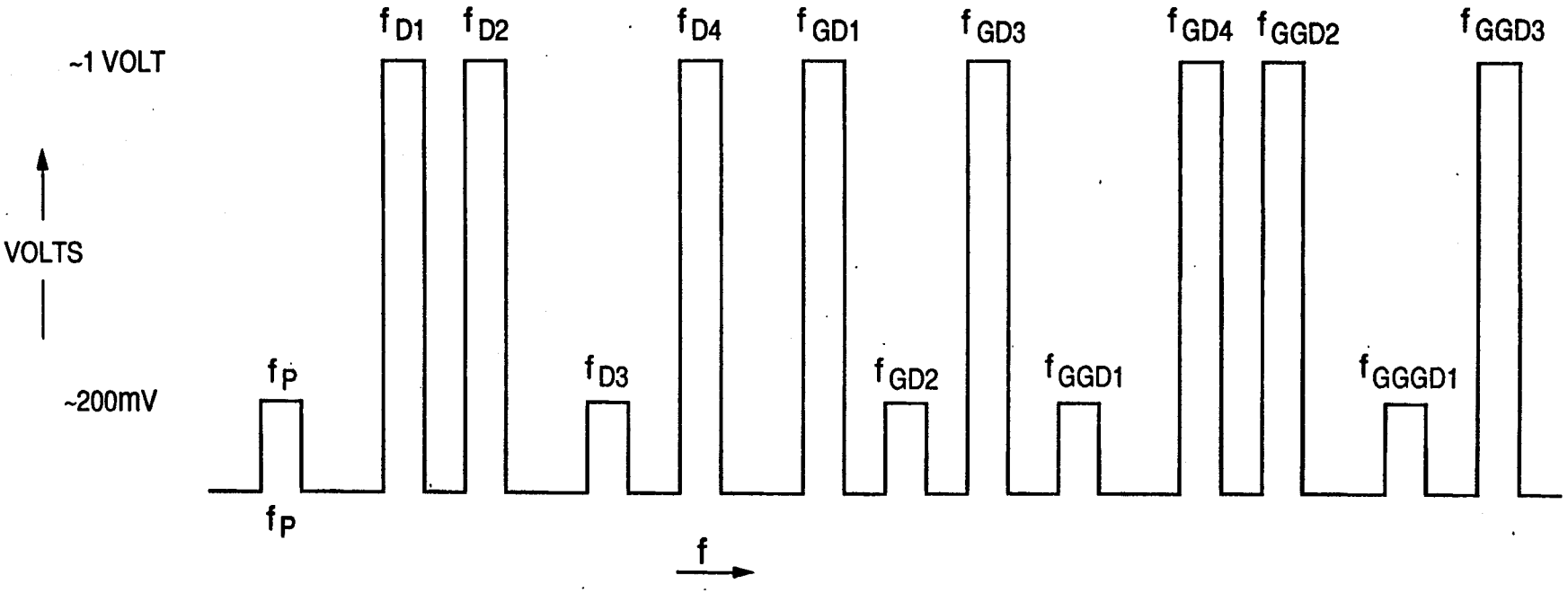
FIG. 7 is a graph of the frequency-amplitude spectrum of a signal generated during performance of a preferred embodiment of the invention.

An example of a supplemental voltage signal suitable for application during step B of the FIG. 5 method will next be described with reference to FIG. 7. FIG. 7 is a frequency-amplitude spectrum which represents a signal having eight high power frequency components ($f_{d1}$, $f_{d2}$, $f_{d4}$, $f_{gd1}$, $f_{gd3}$, $f_{gd4}$, $f_{ggd2}$, and $f_{ggd3}$), and five low power frequency components ($f_p$, $f_{d3}$, $f_{gd2}$, $f_{ggd1}$, and $f_{gggd1}$). The amplitude of each low power component is about 200 mV. The amplitude of each high power component is in the range from about 1 volt to about 10 volts. When applied to an ion trap, all frequency components of the FIG. 7 signal are applied simultaneously.

When applied during step B of the FIG. 5 method, the FIG. 7 signal isolates a particular great-great-granddaughter ion species (identified as "gggd1" in FIG. 7) in the trap, so that daughters of this species can be detected during step C. The ion species is isolated as follows. Component $f_p$ induces dissociation of trapped parent ions "p" into four species of daughter ions (d1, d2, d3, and d4). High power signal components $f_{d1}$, $f_{d2}$, and $f_{d4}$ immediately eject the species d1, d2, and d4 from the trap. At the same time, component $f_{d3}$ induces dissociation of daughter ions d3 into four species of granddaughter ions (gd1, gd2, gd3, and gd4). High power signal components $f_{gd1}$, $f_{gd3}$, and $f_{gd4}$ immediately eject the species gd1, gd3, and gd4 from the trap. At the same time, component $f_{gd2}$ induces dissociation of granddaughter ions gd2 into three species of great-granddaughter ions (ggd1, ggd2, and ggd3) High power signal components $f_{ggd2}$, $f_{ggd3}$ immediately eject the species ggd2 and ggd3 from the trap. At the same time, low power component $f_{ggd1}$ induces dissociation of great-granddaughter ions ggd1 into a species of great-great-granddaughter ions ("gggd1"), and low power component $f_{gggd1}$ induces dissociation of great-great-granddaughter ions gggd1 into a generation of great-great-great-granddaughter ions. These great-great-great-granddaughter ions remain in the trap, and can be excited during step C for detection.

Many variations on the FIG. 7 signal are possible. For example, a band of high (or low) power frequency components (consisting of a set of components whose frequencies span a finite frequency range) can be substituted for one or more of the thirteen individual frequency components of FIG. 7.

Many variations on the filtered noise signal of FIG. 6 are also possible. Some such variations have been mentioned above. In another variation on the FIG. 6 signal, the signal's notch spans a wide frequency range (and thus represents a band of frequency components).

In a variation on the FIG. 5 embodiment, ions of interest ("target ions"), and possibly also undesired ions, are stored in a trap. This can be accomplished by performing the steps described above with reference to period "A" of FIG. 5. The target ions can be parent ions, but need not be. Next, optionally, the supplemental AC voltage signal described above with reference to period "B" of FIG. 5 is applied to the trap to eject undesired ions therefrom. Finally (after the optional second step, or immediately after the first step if the optional second step is omitted), a sequence of supplemental voltage signals is applied to the trap, to resonate a desired sequence of trapped target ions (or sets of target ions) for detection. Each supplemental voltage signal is a pulsed signal having a nonzero, finite frequency bandwidth. The supplemental voltage signals can excite the target ions (or sets of target ions) in consecutive mass-to-charge ratio order, or in a desired nonconsecutive mass-to-charge ratio order. The bandwidth of each supplemental voltage signal is chosen to match a resonant frequency or range of frequencies of a selected trapped ion (or a set of trapped ions). Mass resolution is increased by decreasing the bandwidth of each applied supplemental voltage signal. The overall mass analysis rate (the rate at which target ions having mass-to-charge ratios spanning a desired range are resonantly excited) can be increased by increasing the bandwidth of each supplemental voltage signal applied. The bandwidth of each supplemental voltage signal should thus be chosen to achieve a desired balance of mass resolution and mass analysis rate.

Figure 8:
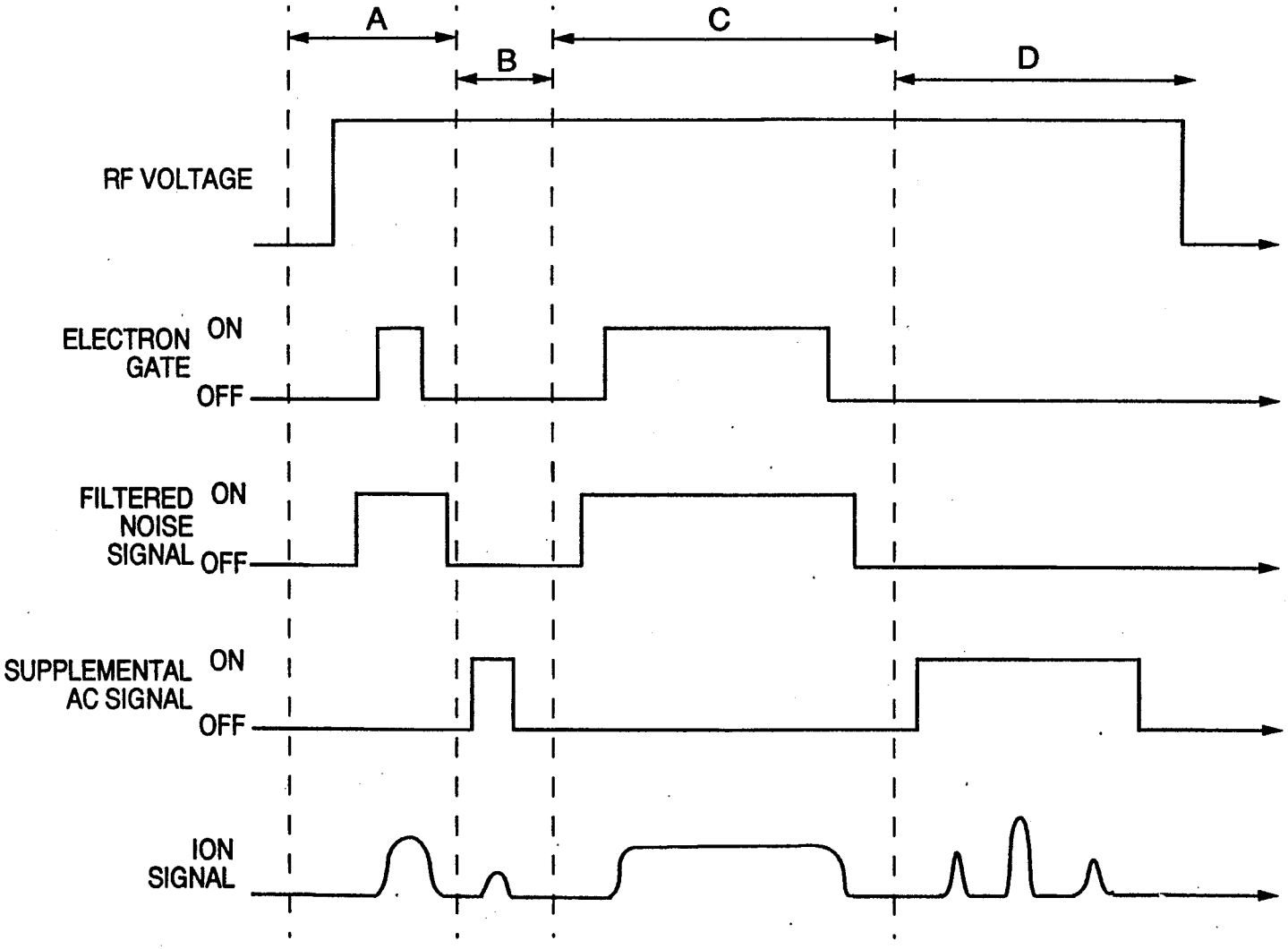
FIG. 8 is a diagram representing signals generated during performance of a second preferred embodiment of the invention.

Another class of preferred embodiments will next be described with reference to FIG. 8. The first step of this method, which occurs during period "A" in FIG. 8, is to store desired ions in a trap. This can, for example, be accomplished by applying a fundamental voltage signal to the trap (by activating generator 14 of the FIG. 1 apparatus) to establish a quadrupole trapping field, and introducing an ionizing electron beam into ion storage region 16 typically, for a short period of on the order of 100 microseconds). Alternatively, the quadrupole trapping field is established and externally produced ions are injected into storage region 16.

Also during step A, a "filtered noise" signal (such as the notch-filtered broadband noise signal in FIG. 6) is applied to the trap. The combined effect of the fundamental voltage signal and the filtered noise signal applied during step A is to cause substantially all undesired ions (including ions resulting from interactions with the electron beam during period A), having undesired mass-to-charge ratios, to escape from region 16. The filtered noise signal can be applied either to the ring electrode (to resonate undesired ions radially) or to one or both of the end cap electrodes (to resonate undesired ions axially).

Before the end of period A, the ionizing electron beam and the filtered noise signal are gated off.

After period A, during period B, a supplemental AC voltage signal is applied to the trap (such as by activating generator 35 of the FIG. 1 apparatus or a second supplemental AC voltage generator connected to the appropriate electrode or electrodes) to resonate a set of target ions for detection. The supplemental AC voltage signal can be designed to resonate the target ions either simultaneously or sequentially. To resonate the target ions for simultaneous detection during period B, the supplemental voltage signal should have a frequency amplitude spectrum including a frequency component (or band of frequency components) for resonating each target ion. Alternatively, the fundamental trapping voltage can be scanned during period B, to sequentially eject the target ions for detection.

The target ion signal detected during period B (i.e., the portion of the "ion signal" in FIG. 8 which occurs during period B) is integrated, and the integrated target ion signal is processed (in a manner that will be apparent to those of ordinary skill in the art) to determine one or more optimizing parameters, such as an "optimum" ionization time or both an "optimum" ionization time and an "optimum" ionization current, needed to store an optimal number i.e., optimal density) of target ions to maximize the system's sensitivity during target ion detection. Application of the optimizing parameters during a subsequent target ion storage step should ideally result in storage of just enough target ions to maximize the system's sensitivity during a target ion detection operation.

Next, during step "C" of the FIG. 8 method, both the ionizing electron beam (or beam of injected ions) and the filtered noise signal are applied to the trap, for the optimum ionization time determined during period B, in order to trap an optimal number of target ions.

Finally, during step "D" of the FIG. 8 method, the trapped target ions are excited for detection. This can be accomplished by applying a broadband supplemental AC voltage signal to simultaneously resonate the target ions for detection. Alternatively, the supplemental voltage signal can consist of sequentially applied AC pulses, each pulse having a frequency (or band of frequencies) matching the resonant frequency of one or more of the target ions. In other variations, mass analysis during period D can be accomplished using a non-consecutive excitation technique, sum resonance scanning, mass selective instability scanning, or scanning the fundamental trapping voltage (or combined fundamental and supplemental trapping voltages).

The sensitivity maximization technique described above with reference to FIG. 8 can be applied in a variety of contexts. For example, it can be performed as a preliminary procedure at the start of an $(MS)^n$ or CI, or combined CI/$(MS)^n$, mass spectrometry operation.

As an example, we next describe a variation of the FIG. 8 method for use in the context of a CI mass spectrometry operation. In this example, the trapping field parameters are set during period A to store reagent, reagent precursor, and product ions. Then, the reagent precursor ions are allowed to react to produce reagent ions, and the reagent ions react with sample molecules to produce product ions during a brief reaction period (of duration, for example, of about one millisecond) after period A, but before period B. Next, during period B, the supplemental voltage signal resonates product ions for detection, and the integral of the detected ion signal is processed to determine both an optimum ionization (electron gate) time for the subsequent period C and an optimum CI reaction time for a subsequent reaction period to occur following the optimum ionization time period. During the subsequent reaction period, reagent ions created and stored during period C would be allowed to react to produce product ions. During the reaction period, the trapping field parameters should be set (or a supplemental AC voltage applied) to store reagent ions and product ions of interest. After the final reaction period, mass analysis is accomplished in the manner described above with reference to period D of Figure B.

As another example, consider the following variation on the FIG. 8 method for implementing an $(MS)^n$ mass spectrometry operation. In this example, the trapping field parameters are set during period A to store daughter ions (including higher order daughter ions) of interest as well as parent ions. Then, the stored parent ions are allowed (or induced) to produce daughter ions during a brief reaction period after period A, but before period B. Next, during period B, the supplemental voltage signal resonates daughter ions of interest for detection, and the integral of the detected ion signal is processed to determine both an optimum ionization (electron gate) time for the subsequent period C and an optimum dissociation time for a subsequent reaction period to occur following period C. During the subsequent reaction period, parent ions stored during period C would be allowed (or induced) to produce daughter ions of interest. During this reaction period, the trapping field parameters should be set (or a supplemental AC voltage applied) to store each daughter ion of interest. After the final reaction period, $(MS)^n$ mass analysis is accomplished by performing a suitable mass analysis technique selected from those described above.

In another variation of the FIG. 8 embodiment of the invention, an "RF/DC mode" quadrupole field is used to inject ions into the ion trap during period A. A set of target ions is injected into the trap region using the "RF/DC mode" quadrupole field (and the injected ions are stored in the trap region). Then, at least some of the stored target ions are excited for detection (for example, by application of a supplemental AC voltage signal of the type applied during period B of FIG. 8), and the resulting target ion signal is detected. An integrated target ion signal is produced by integrating the target ion signal, and the integrated target ion signal is processed to determine optimizing parameters for storing an optimal number of target ions in the trap region (preferably including an optimal duration for injection of target ions into the trap region), wherein excitation of the optimal number of target ions for detection results in maximal target ion detection sensitivity. Then, the optimizing parameters are applied (preferably by injecting target ions into the trap region for said optimal duration) to store the optimal number of target ions within the trap region, and the stored target ions are excited for detection.

In the claims, the term "reaction" is used in a broad sense to denote dissociations (of the type that occur in $(MS)^n$ methods, as well as reactions of the type that occur in CI methods. Also in the claims, the term "product" ion is used in a broad sense, to denote daughter, granddaughter, and higher order daughter ions of the type produced in $(MS)^n$ methods, as well as product ions of the type produced in CI or CI/$(MS)^n$ methods. Also in the claims, the term "parent" ion is used broadly to denote parent ions which dissociate in $(MS)^n$ methods, as well as reagent ions which react in CI methods.

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. A mass spectrometry method, including the steps of:

(a) establishing a trapping field capable of trapping a parent ion, a product ion, and an undesired ion within a trap region bounded by a set of electrodes; and (b) applying a supplemental AC voltage signal to at least one of the electrodes, wherein the supplemental AC voltage signal has a high power frequency component and a low power frequency component, wherein the low power frequency component has an amplitude selected to induce a first reaction of the parent ion, wherein the first reaction produces the product ion, wherein the low power frequency component has a frequency matching a resonant frequency of the parent ion, wherein the high power frequency component has a frequency matching a resonant frequency of the undesired ion, wherein the high power frequency component has an amplitude sufficient to eject the undesired ion from the trap region, and wherein the low power frequency component is applied simultaneously with the high power frequency component.

2. The method of claim 1, wherein the undesired ion is second product ion of the first reaction.

3. The method of claim 1, also including the step of:

(c) after step (b), exciting the product ion for detection.

4. The method of claim 3, wherein step (c) includes the step of resonating said product ion to a degree sufficient for in-trap detection by an in-trap detector.

5. The method of claim 3, wherein the trapping field is a three-dimensional quadrupole trapping field, and wherein the electrodes include a ring electrode and a pair of end electrodes separated along a central axis, and also including the step of:

detecting the product ion using a detector positioned away from the central axis.

6. The method of claim 3, wherein the trapping field is a three-dimensional quadrupole trapping field, and wherein the electrodes include a ring electrode and a pair of end electrodes separated along a central axis, and also including the step of:

detecting the product ion using a detector positioned along the central axis.

7. The method of claim 1, wherein the supplemental AC voltage signal has a band of frequency components including said high power frequency component.

8. The method of claim 1, wherein the supplemental AC voltage signal has a band of frequency components including said low power frequency component.

9. The method of claim 1, wherein step (a) includes the step of applying a filtered noise signal to at least one of the electrodes to resonate out of the trap region unwanted ions, other than the parent ion.

10. The method of claim 9, wherein the trapping field is a three-dimensional quadrupole trapping field, wherein the electrodes include a ring electrode and a pair of end electrodes, wherein step (a) includes the steps of:

applying a fundamental voltage signal to the ring electrode to establish the trapping field; and applying the filtered noise signal to the ring electrode to resonate the unwanted ions out of the trap region in radial directions toward the ring electrode.

11. The method of claim 1, wherein the trapping field is a three dimensional quadrupole trapping field, and wherein step (a) includes the step of:

applying to the electrodes a fundamental voltage signal having a radio frequency component.

12. The method of claim 1, wherein the low power frequency component has amplitude in the range from about 100 millivolts to about 200 millivolts, and the high power frequency component has amplitude in the range from about 1 volt to about 10 volts.

13. A mass spectrometry method, including the steps of:

(a) establishing a trapping field capable of trapping parent ions, product ions, and undesired ions within a trap region bounded by a set of electrodes; and (b) applying a supplemental AC voltage signal to the electrodes, wherein the supplemental AC voltage signal has at least two high power frequency components and at least two low power frequency components, wherein the low power frequency components have amplitudes selected to induce reactions of trapped ions, and the low power frequency components have frequencies matching resonant frequencies of the trapped ions, wherein the reactions produce product ions, wherein the high power frequency components have frequencies matching resonant frequencies of undesired ions, and wherein the high power frequency components have amplitudes sufficient to eject the undesired ions from the trap region, and wherein the low power frequency components are applied simultaneously with the high power frequency components.

14. The method of claim 13, wherein at least one of the undesired ions is one of the product ions.

15. The method of claim 13, also including the step of:

(c) after step (b), exciting selected ones of the product ions for detection.

16. The method of claim 15, wherein the selected ones of the product ions are excited in non-consecutive mass order for detection.

17. The method of claim 15, wherein step (c) includes the step of resonating the selected ones of the product ions to a degree sufficient for in-trap detection by an in-trap detector.

18. The method of claim 15, wherein the trapping field is a three-dimensional quadrupole trapping field, and wherein the electrodes include a ring electrode and a pair of end electrodes separated along a central axis, and also including the step of:

(d) detecting the product ions using a detector positioned away from the central axis.

19. The method of claim 15, wherein the trapping field is a three-dimensional quadrupole trapping field, and wherein the electrodes include a ring electrode and a pair of end electrodes separated along a central axis, and also including the step of:

(d) detecting the product ion using a detector positioned along the central axis.

20. The method of claim 13, wherein the supplemental AC voltage signal has a band of frequency components including a first one of said high power frequency components.

21. The method of claim 13, wherein the supplemental AC voltage signal has a band of frequency components including a first one of said low power frequency components.

22. The method of claim 13, wherein the low power frequency components have amplitudes selected to induce at least one reaction of a first parent ion, and wherein step (a) includes the step of applying a filtered noise signal to at least one of the electrodes to resonate out of the trap region unwanted ions other than said first parent ion.

23. The method of claim 13, wherein the low power frequency components have amplitudes in the range from about 100 millivolts to about 200 millivolts, and the high power frequency components have amplitudes in the range from about 1 volt to about 10 volts.

24. A mass spectrometry method, including the steps of:

(a) establishing a trapping field capable of trapping target ions and undesired ions within a trap region bounded by a set of electrodes; and (b) after step (a), applying a sequence of supplemental voltage signals to at least one of the electrodes, to resonantly excite a desired sequence of the target ions for detection, wherein each of the supplemental voltage signals is a pulsed signal having a nonzero, finite frequency bandwidth.

25. The method of claim 24, wherein the bandwidth of each of the supplemental voltage signals is a narrow bandwidth spanning a resonant frequency of a selected one of the trapped ions.

26. The method of claim 24, wherein the bandwidth of each of the supplemental voltage signals is chosen to match a range of frequencies of a set of selected ones of the trapped ions.

27. The method of claim 24, also including the step of:

(c) after step (a) and before step (b), applying a supplemental AC voltage signal to at least one of the electrodes, to eject at least some of the undesired ions from the trap region.

28. A mass spectrometry method, including the steps of:

(a) establishing a trapping field capable of trapping target ions and undesired ions within a trap region bounded by a set of electrodes, and storing a set of target ions and undesired ions within the trap region;

(b) applying a filtered noise signal to at least one of the electrodes to resonate out of the trap region at least some of the undesired ions;

(c) after step (b), exciting at least some of the target ions for detection, and detecting a target ion signal resulting from excitation of said at least some of the target ions;

(d) generating an integrated target ion signal by integrating the target ion signal and processing the integrated target ion signal to determine optimizing parameters for storing an optimal number of target ions in the trap region, wherein excitation of the optimal number of target ions for detection results in maximal target ion detection sensitivity;

(e) after step (d), applying the optimizing parameters to store said optimal number of target ions within the trap region; and (f) exciting for detection the target ions stored during step (e).

29. The method of claim 28, wherein step (e) also includes the step of applying the filtered noise signal to at least one of the electrodes to resonate undesired ions out of the trap region.

30. The method of claim 28, wherein step (f) includes the step of applying a sequence of supplemental voltage signals to at least one of the electrodes, to resonantly excite a desired sequence of the target ions for detection.

31. The method of claim 28, wherein the optimizing parameters include an optimum ionization time.

32. The method of claim 31, wherein step (e) includes the step of introducing an ionizing beam into the trap region for said optimum ionization time.

33. The method of claim 31, wherein step (e) includes the step of injecting a beam of ions into the trap region for said optimum ionization time.

34. The method of claim 28 wherein the target ions are product ions, wherein reagent ions and precursor ions are stored during step (a), and also including the step of:

after steps (a) and (b) but before step (c), allowing the reagent ions and the precursor ions stored during step (a) to react, thereby producing product ions, and wherein at least some of the product ions are excited for detection during step (c).

35. The method of claim 28, wherein the target ions are daughter ions, wherein parent ions are stored during step (a), and also including the step of:

after steps (a) and (b) but before step (c), allowing or inducing at least some of the parent ions stored during step (a) to dissociate, thereby producing daughter ions, and wherein at least some of the daughter ions are excited for detection during step (c).

36. The method of claim 28, wherein step (c) includes the step of changing the trapping field to excite said at least some of the target ions for detection.

37. The method of claim 28, wherein step (c) includes the steps of:

applying a supplemental voltage signal to at least one of the electrodes, thereby establishing a combined trapping field within the trap region; and changing the combined trapping field to excite said at least some of the target ions for detection.

38. The method of claim 28, wherein step (f) includes the step of changing the trapping field to excite said target ions for detection.

39. The method of claim 28, wherein step (f) includes the steps of:

applying a supplemental voltage signal to at least one of the electrodes, thereby establishing a combined trapping field within the trap region; and changing the combined trapping field to excite said target ions for detection.

40. The method of claim 28, wherein step (c) includes the step of applying a supplemental AC voltage signal to at least one of the electrodes to resonantly excite said at least some of the target ions for detection.

41. A mass spectrometry method, including the steps of:

(a) establishing an RF/DC mode quadrupole field and employing said RF/DC mode quadrupole field to inject target ions into a trap region bounded by a set of electrodes;

(b) exciting at least some of the target ions for detection, and detecting a target ion signal resulting from excitation of said at least some of the target ions;

(c) generating an integrated target ion signal by integrating the target ion signal and processing the integrated target ion signal to determine optimizing parameters for storing an optimal number of target ions in the trap region, wherein excitation of the optimal number of target ions for detection results in maximal target ion detection sensitivity;

(d) after step (c), applying the optimizing parameters to store said optimal number of target ions within the trap region; and (e) exciting for detection the target ions stored during step (d).

42. The method of claim 41, wherein the optimizing parameters include an optimal duration for injection of target ions into the trap region, and wherein step (d) includes the step of injecting target ions into the trap region for said optimal duration.

43. The method of claim 41, wherein step (b) includes the step of applying a supplemental AC voltage signal to at least one of the electrodes to resonantly excite said at least some of the target ions for detection.

44. The method of claim 41, wherein step (b) includes the step of changing the trapping field to excite said at least some of the target ions for detection.

45. The method of claim 41, wherein step (b) includes the steps of:

applying a supplemental voltage signal to at least one of the electrodes, thereby establishing a combined trapping field within the trap region; and changing the combined trapping field to excite said at least some of the target ions for detection.

46. The method of claim 41, wherein step (e) includes the step of changing the trapping field to excite said target ions for detection.

47. The method of claim 41, wherein step (e) includes the steps of:

applying a supplemental voltage signal to at least one of the electrodes, thereby establishing a combined trapping field within the trap region; and changing the combined trapping field to excite said target ions for detection.

48. The method of claim 41, wherein step (e) includes the step of applying a sequence of supplemental voltage signals to at least one of the electrodes, to resonantly excite a desired sequence of the target ions for detection.

* * * * *